US010590925B2

(12) United States Patent
Schwarz et al.

(10) Patent No.: US 10,590,925 B2
(45) Date of Patent: Mar. 17, 2020

(54) CONTROL SYSTEM AND METHOD FOR RECIPROCATING COMPRESSORS

(75) Inventors: Marcos Guilherme Schwarz, Joinville (BR); Filipe Guolo Nazario, Joinville (BR)

(73) Assignee: Embraco—Industria De Compressores E Solucoes EM Refrigeracao Ltda., Joinville (BR)

( * ) Notice: Subject to any disclaimer, the term of this patent is extended or adjusted under 35 U.S.C. 154(b) by 342 days.

(21) Appl. No.: 13/982,126

(22) PCT Filed: Jan. 25, 2012

(86) PCT No.: PCT/BR2012/000014

§ 371 (c)(1), (2), (4) Date: Nov. 12, 2013

(87) PCT Pub. No.: WO2012/100313

PCT Pub. Date: Aug. 2, 2012

(65) Prior Publication Data

US 2014/0072451 A1 Mar. 13, 2014

(30) Foreign Application Priority Data

Jan. 26, 2011 (BR) ..... 1100026

(51) Int. Cl.
*F04B 49/06* (2006.01)
*F04B 49/02* (2006.01)
(Continued)

(52) U.S. Cl.
CPC ..... *F04B 49/06* (2013.01); *F04B 35/04* (2013.01); *F04B 49/02* (2013.01); *F04B 49/065* (2013.01);
(Continued)

(58) Field of Classification Search
CPC ..... F04B 17/03; F04B 35/04; F04B 49/06; F04B 2201/127; F04B 2201/0201;
(Continued)

(56) References Cited

U.S. PATENT DOCUMENTS 3,540,813 A 11/1970 Murphy
4,355,959 A * 10/1982 Kono ..... F04B 27/1036 417/223
(Continued)

FOREIGN PATENT DOCUMENTS

DE 20 2012 013 046 U1 10/2014
EP 2 669 519 A1 12/2013
(Continued)

OTHER PUBLICATIONS

JP2007092686 English Translation, machine translation generated on Jun. 28, 2018 from EPO website.*
(Continued)

*Primary Examiner* — Bryan M Lettman
(74) *Attorney, Agent, or Firm* — Harrington & Smith

(57) ABSTRACT

A control system for hermetic cooling compressor includes a reciprocating compressor (3) and an electronic control (2) for the reciprocating compressor (3). The electronic control (2) is configured for, after commanding the turning off of the reciprocating compressor (3), detecting whether the turn velocity (23) of the turning axle (10) is below a predefined velocity level, and then applying a braking torque (36) that causes deceleration of the turning axle (10) before completing the next turn of the turning axle (10), in case the turn velocity (23) detected is below the velocity level (34).

16 Claims, 3 Drawing Sheets

(51) Int. Cl.
*F04B 49/20* (2006.01)
*F04B 35/04* (2006.01)
*F04B 49/10* (2006.01)

(52) U.S. Cl.
CPC ..... *F04B 49/103* (2013.01); *F04B 49/20* (2013.01); *F04B 2201/0201* (2013.01); *F04B 2201/0209* (2013.01); *F04B 2201/127* (2013.01)

(58) Field of Classification Search
CPC ..... F04B 2201/0209; F04B 49/103; F04B 49/02; F04B 49/20; F04B 49/065
See application file for complete search history.

(56) References Cited

U.S. PATENT DOCUMENTS

| | | | | |
|---|---|---|---|---|
| 5,820,349 | A | 10/1998 | Caillat | |
| 5,986,419 | A | 11/1999 | Archer et al. | |
| 6,121,739 | A * | 9/2000 | Haberlander | F04B 49/06 318/362 |
| 6,544,017 | B1 | 4/2003 | Skinner | |
| 7,300,257 | B2 | 11/2007 | Lifson et al. | |
| 2003/0180148 | A1 | 9/2003 | Weng | |
| 2009/0019835 | A1* | 1/2009 | Dingle | F01N 11/00 60/282 |
| 2010/0021313 | A1* | 1/2010 | Devan | F04B 17/03 417/44.1 |

FOREIGN PATENT DOCUMENTS

| | | | |
|---|---|---|---|
| JP | 60-153483 | | 8/1985 |
| JP | 2000-287485 | | 10/2000 |
| JP | 2001-037281 | | 2/2001 |
| JP | 2007-092686 | | 4/2007 |
| JP | 2007092686 | * | 4/2007 |
| JP | 2010-270700 | | 12/2010 |
| WO | WO 2004/083744 A1 | | 9/2004 |

OTHER PUBLICATIONS

International Search Report dated May 31, 2012 for International Application No. PCT/BR2012/000014.
First Written Opinion dated May 31, 2012 for International Application No. PCT/BR2012/000014.
Second Written Opinion dated Jan. 7, 2013 for International Application No. PCT/BR2012/000014.
International Preliminary Report on Patentability dated Apr. 26, 2013 for International Application No. PCT/BR2012/000014.
Office Action with English translation dated Oct. 27, 2015 for Japanese Application No. 2013-550708.
Correspondence requesting accelerated examination to the European Patent Office dated Dec. 3, 2014 for European Patent Application No. 12709775.6.
Search Report from the German Patent and Trademark Office dated Sep. 30, 2015 for German Application No. 20 2012 013 046.3 (Cite No. 7).

* cited by examiner

CONTROL SYSTEM AND METHOD FOR RECIPROCATING COMPRESSORS

The present invention relates to a system and a method that enable one to control the stopping (braking) behavior of a reciprocating compressor.

DESCRIPTION OF THE PRIOR ART

Hermitic compressor of reciprocating type comprise rod-crank-and-piston type with reciprocating movement and are widely used in the cooling-equipment, household and commercial industry.

Reciprocating compressors may be of the fixed-capacity type, wherein the control of two fixed-velocity states (ON/OFF) is carried out upon turning on the compressor at a maximum temperature and turning off the compressor at a minimum temperature, or varying-capacity compressors, wherein the control is carried out by some electromechanical device or electronic circuit, capable of responding to a programming dependent upon variables to be controlled on the cooling equipment, as for instance the inner temperature of the compartments, wherein the compressor acts in reciprocating operation cycles at varying velocities and stop.

During the periods of operation, the reciprocating compressors are responsible for circulating the cooling gas through the cooling circuit, the rod-crank-and-piston mechanism being responsible for carrying out cyclic movements in which the piston raises the gas pressure during its advance and the cooling gas applied a contrary stress onto the mechanism and to the turning axle. This stress on the piston and the consequent reaction on the mechanism and turning axle varies significantly throughout a turn of the turning axle, the variation being directly proportional to the values of cooling-gas pressure (the greater the difference between the pressures of evaporation and of condensation of the cooling circuit, the greater it is).

Thus, with cooling equipment that uses reciprocating compressors, at the moments when the compressor is turned off the mechanism still turns due to the inertia of the assembly, mainly the inertia of the motor rotor, which imposes the turning movement. The inertia movement causes a jolt during the stopping of the compressor due to a contrary impulse on the piston, caused by the different in pressure of the gas. The impulse is caused by the abrupt stopping of the axle or by the turning movement in an opposite direction at the last turn of the axle because the piston is not capable of overcoming the pressure. Thus, the gas is compressed and uncompressed in an alternating movement, which may cause problems to the reciprocating compressor.

Because of this, the stopping jolt is typical in reciprocating compressors for cooling. Generally, one designs suspension-spring systems inside the compressor, which support the whole assembly, so as to absorb impulses and attenuate them, and not cause problems, such as spring breaks or stopping noises due to shocks between parts. The greater the difference in pressure under which the compressor is operating, the greater the stopping impulses will be.

One of the engineering solutions to the jolt problem when the compressor is stopping is a balanced design of the suspension springs. The main function of the suspension springs is to attenuate the transmission of the vibrations generated during the normal operation in the pumping system due to the reciprocating movement of the piston, thus preventing these vibrations from passing on to the outer compressor body and, as a result, to the cooler, which causes noises. In this way, the springs should then be soft enough to attenuate the normal-functioning vibration, besides absorbing the stopping impulse. On the other hand, the springs should not be designed to be excessively soft to the point of allowing a long displacement of the assembly during this stopping impulse, since this may cause shocks at the mechanical stops, raising noises. Similarly, the design should be adopted so as not to cause excessive stress on the springs to the point of causing fatigue or breakage thereof.

It is possible to note that the stopping jolt is more intense on compressors that operate with greater differences in pressure and on compressors that have smaller inner mass of their components. Besides, factors linked to the pressure condition and to the assembly mass make it difficult to design the suspension springs, and the more one wants to attenuate the normal-operation vibration the higher this project will be, especially in operation at low rotations. Because of this, one encounters even more severe contour conditions, which are difficult to be met.

In deigns where there are severe pressure conditions, optimization of the assembly weight and the need to reduce considerably the vibration level in low-rotation operation, the solution to the spring design may not meet all the desired conditions.

OBJECTIVES OF THE INVENTION

Therefore, it is a first objective of this invention to provide a system and a method for reducing the rigidity of the springs of the suspension system, thus minimizing the vibration level during normal operation.

It is another objective of this invention to provide a system and a method that are capable of reducing the demand for robustness of the suspension system, maintaining the level of reliability and useful life of the springs, by preventing breakage thereof.

A further objective of this invention is to provide a system and a method that are capable of enabling the compressor to operate in conditions of high difference in pressure, under which it can be turned off without undesired impacts and noises being generated.

BRIEF DESCRIPTION OF THE INVENTION

The objectives of the invention are achieved by means of a control system for cooling compressors, the system comprising at least one electronic control and one reciprocating compressor, which comprises at least one mechanical assembly that has at least one compression mechanism and one motor, the control system being configured to detect a rotation velocity of the compression mechanism and apply a braking torque to the mechanical assembly after detecting that the turning velocity is below a velocity level.

Additionally, one further proposes a control method for a hermetis compressor for cooling, comprising the steps of:

(a) detecting a turning velocity of a mechanical assembly, which comprises at least the compression mechanism and a motor;

(b) comparing the turning velocity with a velocity level; and (c) applying a braking torque for decelerating the mechanical assembly if the detection indicates that the turning velocity is below a velocity level.

BRIEF DESCRIPTION OF THE DRAWINGS

The present invention will now be described in greater detail with reference to the following figures.

DETAILED DESCRIPTION OF THE FIGURES AND OF THE INVENTION

Figure 1:
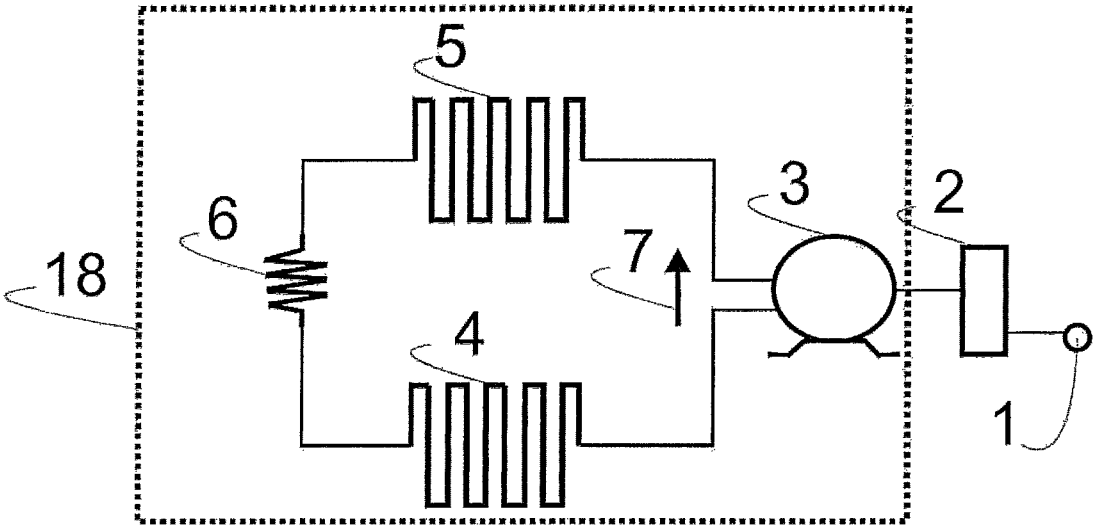
FIG. 1—representation of a cooling system.

As represented in FIG. 1, a cooling system comprises a reciprocating compressor 3, which is fed by an electric power network 1 and has an electronic controller 2 capable of controlling the operation of a reciprocating compressor 3. The reciprocating compressor 3 drives a cooling gas in a gas-circulation closed circuit 18, creating a cooling-gas flow 78 inside this circuit, directing the gas to a condenser 5. After the condenser 5, the cooling gas goes though a flow-cooling device 6, which may be, for instance, a cappillary tube. Then, the gas is led to an evaporator 4 and later returns to the reciprocating compressor 3, restarting the gas-circulation circuit.

Figure 2:
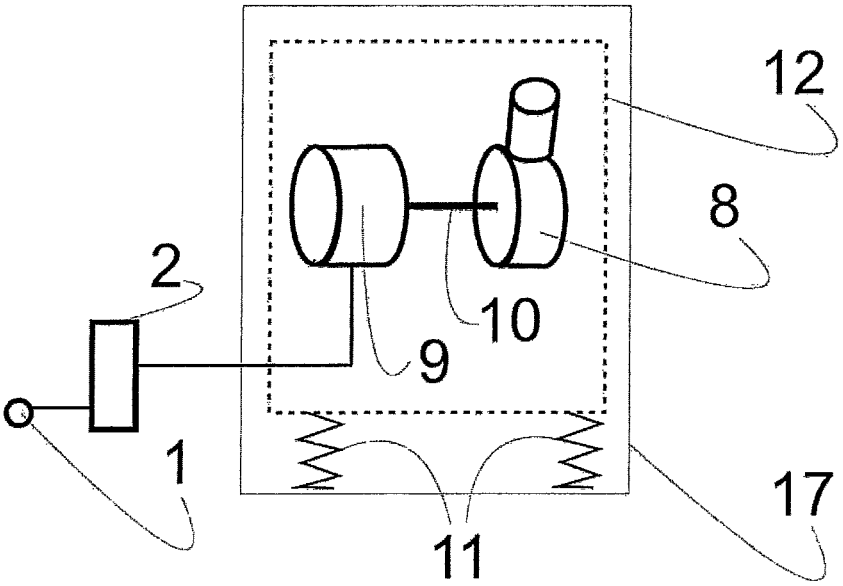
FIG. 2—representation of the control of a compressor, as well as the main subsystems inside the compressor.

FIG. 2 illustrates a focus in subsystems inside the reciprocating compressor, the reciprocating compressor 3 being formed by a housing 17, suspension springs 11 that are responsible for damping the mechanical vibration generated by the movement of a mechanical assembly 12, formed by the motor 9 and the compression mechanisms 8, which are interconnected mechanically by the axle 10 that transmits torque and rotary motion.

The mechanical vibrations generated by the compression mechanism 8, due to the unbalancing and torque variation, are filtered by the suspension springs 11. For this reason, the suspension springs 11 are projected so as to have a low elasticity coefficient (that is, as soft as possible), in order to increase the effectiveness of vibration filtration. However, this design increases the amplitude of the oscillation transient and displacement of the mechanical assembly 12 during the stop of the reciprocating compressor 3, if the suspension springs 11 are made to soft, being capable of causing mechanical shocks between the mechanical assembly 12 (drive and compression) against the housing 17 of the reciprocating compressor 3, generating acoustic noise and possible fatigues or breaks of the suspension springs 11.

Figure 3:
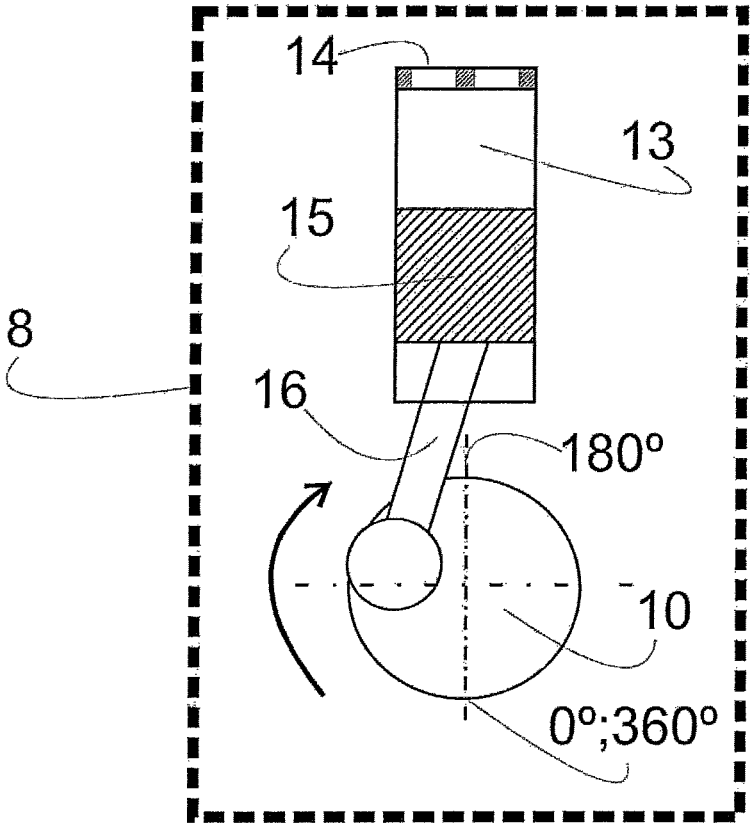
FIG. 3—representation of details of the mechanical subsystem of a reciprocating compressor.

FIG. 3 shows the compression mechanism 8, which comprises a turning axle 10, to which the rod 16 is coupled. The rod 16 modifies the rotary motion of the turning axle 10 during the reciprocating motion, which drives a piston 15 to move inside a cylinder 13, causing the compressed gas to circulate through a valve plate 14. This mechanism compresses the gas, so that high differences in pressure and high reaction torque peaks are generated. The rotary motion of the turning axle 10 is kept by its own inertia, its average velocity being maintained by the production of torque by the motor 9.

Figure 4:
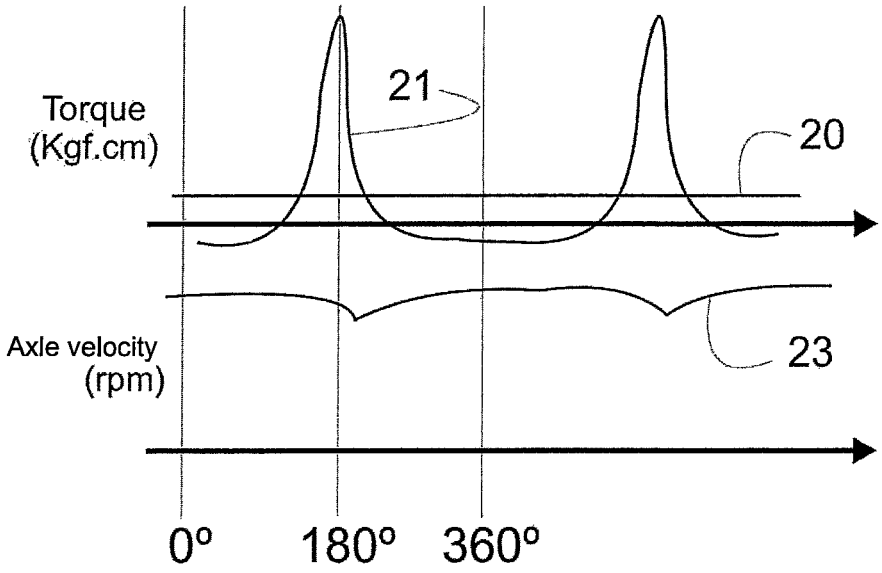
FIG. 4—representation of the compression process and of the velocity of the axle of a compressor.

FIG. 4 presents an operation torque 20, generated by the motor 9, which encounters a reaction torque 21 of the compression mechanism 8, configured to cause a variation of a turning velocity 23 of the turning axle 10 of the reciprocating compressor 3. This turning velocity 23 of the turning axle 10 varies throughout a compression cycle, which begins at the lower dead point of the piston 15, generally when the turn angle is zero, reaching the maximum compression and the maximum reaction torque 21 generally at a lower angle close to 180 degrees of turn, thus causing deceleration of the axle.

Figure 5:
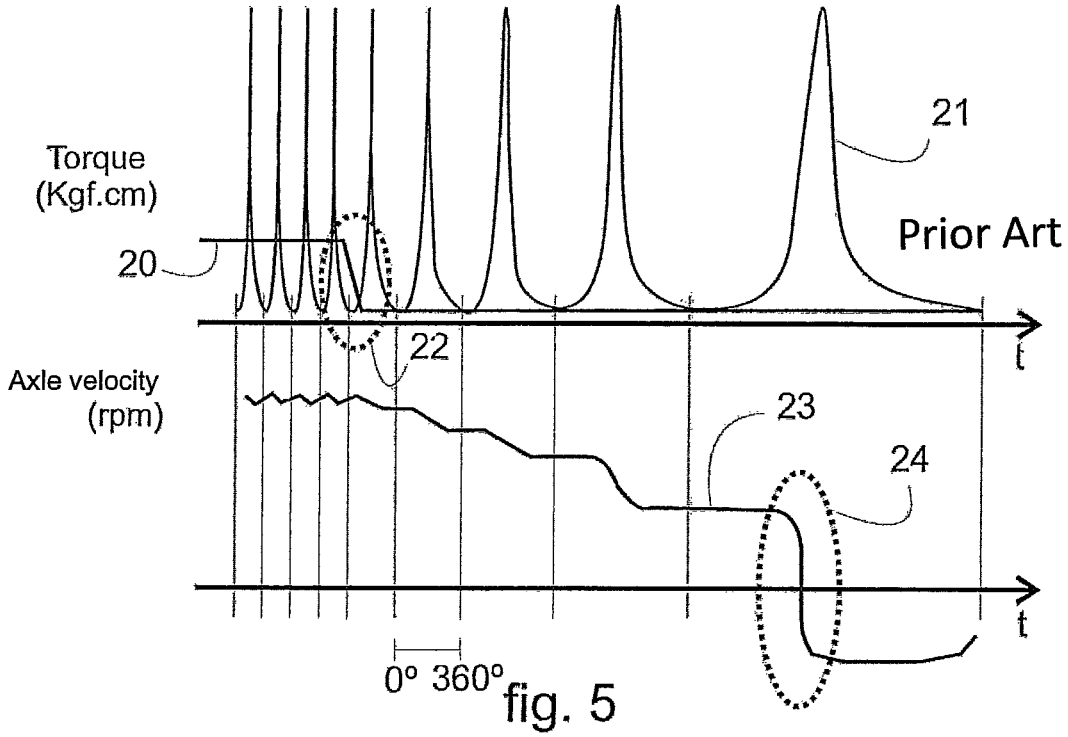
FIG. 5—representation of the compression process and of the velocity of the axle of a compressor during the start according to the state of the art.

As can be seen in FIG. 5, during the stopping process of the reciprocating compressor 3 according to the state of the art, at the stopping moment 22 when the motor 9 stops generating operation torque 20, the compression mechanism 8 continues its inertia movement fed by the kinetic energy stored on the turning axle 10, the turn velocity 23 of the turning axle 10 decreasing gradually with every compression cycle that is completed, extracting kinetic energy from the turning mass axle 10, until the impulse moment 24, when, due to the very reduced rotation of the turning axle thee is not sufficient energy to complete the compression cycle.

Thus, the turning axle 10 loses turn velocity 23 quickly, that it, a high deceleration (rpm/s) takes place, which causes a reverse impulse in the compression mechanism 8 at the impulse moment 24. The deceleration of the compression mechanism 8 in a very short period of time drives the whole mechanical assembly 12 and may cause the turning axle 10 to turn in the opposition direction. The kinetic energy of the turning axle 10 depends on the rotation (squared) and on the inertia of the turning axle 10. The reverse impulse that takes place at the abrupt stop causes a strong impulse on the mechanical assembly 12 and, in this way, causes a large displacement and possible mechanical shock between mechanical assembly 12 and housing 17, thus causing noise and fatigue of the suspension springs 11.

Figure 6:
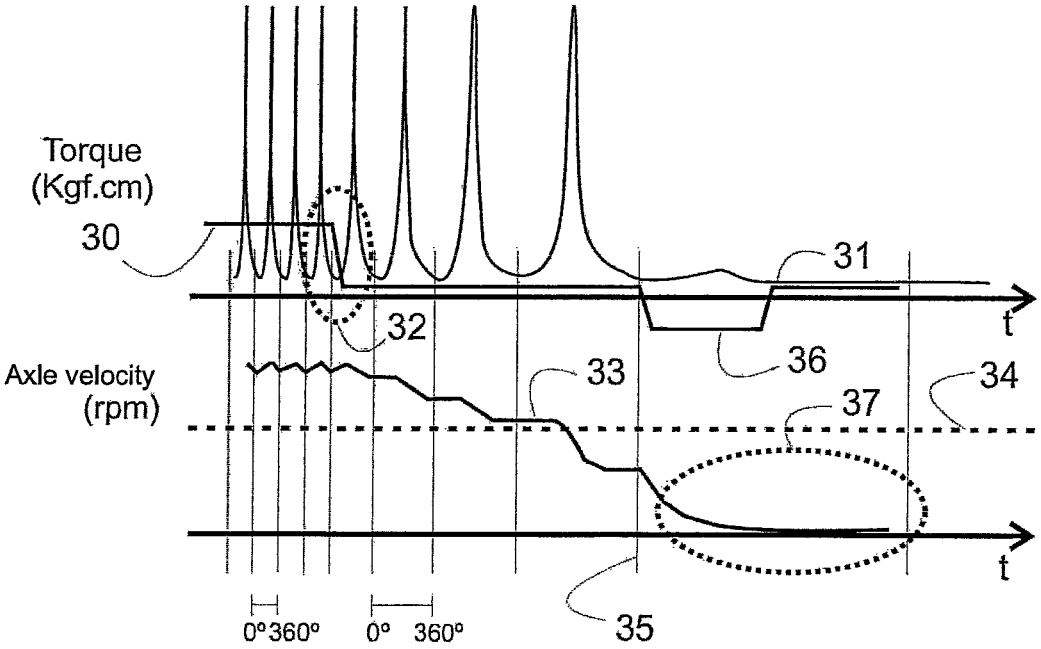
FIG. 6—representation of the compression process and of the velocity of the axle of a compressor during the start according to the present invention.

FIG. 6, in reversed way, shows a graph according to the present invention, which shows the solution of the problems indicated, wherein, during the stopping process of the reciprocating compressor 3, at the braking moment 32 when the motor 9 stops generating operation torque, the compression mechanism 8 continues its inertia movement fed by the kinetic energy stored on the turning axle 10, the turn velocity 23 of the turning axle 10 decreasing gradually until the rotation of the turning axle 10 will be lower than a velocity level 34. When the electronic controller 2 detects that the rotation of the turning axle 10 reaches the velocity level 34, at the following moment 35 the electronic controller 2 applies a braking torque 36 in the opposite direction to the turn of the compression mechanism 8.

Preferably, this detection is made by the electronic control 2, which detects the time between the changes of rotor position. As can be seen ion FIGS. 5 and 6, the period of stroke of the piston (0° to 360°) varies in an inversely proportional way with respect to the velocity. In this way, the electronic control 2 can be configured to detect the period which the compression mechanism 8 needs to carry out its movement (from 0° to 360°) and compare such a period with a maximum reference time. This maximum reference time is related with the period which the compression mechanism 8 needs to carry out its movement at the velocity level 34. In this way, one can state that the braking torque 36 is applied when the rotation velocity of the turning axle 10 is below a velocity level 34 that is predefined by the electronic control 2. In the preferred embodiments of the present invention, the braking torque 36 is generally applied when the reaction torque 31 goes though one of its maximum values (peaks), to facilitate the braking by using the inertia of the motor 9, which is already under deceleration. The most relevant aspects of this braking torque 36 are its intensity, which depends on the level of current that will circulate through the windings of the motor 9, and its duration, which may go from the moment when it reaches the velocity level 34 until complete stop of the motor 9.

The application of the braking torque 36 may be made in various ways. Preferably one employs the methods of adding a resistance between the windings of the motor 9, which causes the current generated by the movement of the motor 9 to circulate ion a closed circuit and generates a torque contrary to the motion (which may also be carried out by means of a PWM modulation of the inverter that controls the motor 9), or the application of a current contrary to that applied to the motor 9 when it is in operation.

This following 35 following the velocity level 34 comprises much of the last turn of the turning axle 10, beginning a braking period 37 of the turning axle 10. In this way, one prevents the last compression cycle from taking place, thus preventing also a strong reverse impulse on the compression mechanism 8. In this way, the deceleration of the turning axle 10 takes place and is distributed throughout the last turn in a controlled manner, resulting in a deceleration value (rpm/s) that is substantially lower than the one observed in the present-day art. In order for this event to take place, the rotation velocity level 34 of the turning axle 10 should preferably be sufficient for the kinetic energy stored on the turning axle 10 of the reciprocating compression 3 to be capable of completing a complete compression cycle, thus preventing the sudden deceleration and jolt of the compression mechanism 8.

Thus, the present invention enables the suspension springs 11 of the mechanism 12 to be designed so as to have low elasticity coefficient, being very effective to filter vibration, and still prevents shocks of the mechanical assembly 12 with the housing 17 of the reciprocating compressor 3. Besides, the present invention prevents high displacement of this mechanical assembly 12 during the stopping transient, minimizing the mechanical stress and fatigue caused to the suspension springs 11.

Therefore, the present invention defines a system and a method that reduces significantly (or even eliminates) jolts on the mechanical assembly of the compressor during its stop, by means of controlled deceleration of the rod-crank-and-piston assembly throughout the last turn of the turning axle, this preventing the piston from decelerating abruptly during the last incomplete gas compression cycle and also preventing the production of a high impulse with torque.

A preferred example of embodiment having been described, one should understand that the scope of the present invention embraces other possible variants, being limited only by the contents of the accompanying claims, which include the possible equivalents.

The invention claimed is:

1. A cooling compressor control system comprising:

an electronic control (2); and a reciprocating compressor (3) comprising a mechanical assembly (12) including a compression mechanism (8), said compression mechanism comprising a reciprocating piston (15) coupled to a turning axle (10), and said mechanical assembly (12) further comprising a motor (9) that rotates the turning axle (10) to reciprocate the piston (15);

wherein the electronic control (2) is configured to detect a rotation turn velocity (33) of the compression mechanism (8) during a stopping process of the reciprocating compressor (3) and to apply a braking torque (36) to the mechanical assembly (12) after detecting that the rotation turn velocity (33) is below a predefined velocity level (34); and wherein the electronic control is adapted to determine whether the rotation turn velocity is below the predefined velocity level by detecting a period that the compression mechanism needs to carry out a movement and to compare the period with a maximum reference time, the maximum reference time being related with the period which the compression mechanism needs to carry out the movement at the predefined velocity level.

2. A system according to claim 1, wherein the electronic control (2) is adapted to apply the braking torque (36) continuously until the mechanical assembly (12) stops.

3. A system according to claim 1, wherein the predefined velocity level (34) is configured to guarantee that an inertia of the mechanical assembly (12) will be capable of carrying out a complete compression cycle.

4. A system according to claim 3, wherein the application of the braking torque (36) is initiated at a next moment (35) after a compression cycle has been completed.

5. A system according to claim 4, wherein the application of the braking torque (36) is finished at a moment when the new compression cycle begins.

6. A system according to claim 1, wherein the braking torque (36) is configured for a deceleration of the rotation turn velocity (33).

7. A system according to claim 6, wherein the rotation turn velocity (33) of the compression mechanism (8) has a zero value at a moment when a new compression cycle begins.

8. A system according to claim 1, wherein the braking torque (36) has a direction opposite to that of the rotation turn velocity (33).

9. A control method for a hermetic cooling reciprocating compressor (2), comprising the steps of:

(a) detecting a rotation turn velocity (33) of a mechanical assembly (12) that comprises a compression mechanism (8) and a motor (9) during a stopping process of the reciprocating compressor (3), said compression mechanism comprising a reciprocating piston (15) coupled to a turning axle (10), said turning axle (10) driven by said motor (9);

(b) comparing the rotation turn velocity (33) with a predefined velocity level (34); and (c) applying a braking torque (36) for a deceleration of the mechanical assembly (12) after detecting that the rotation turn velocity (33) is below the predefined velocity level (34);

wherein the step (a) detects a period which the compression mechanism (8) needs to carry out a movement and the step (b) compares the period with a maximum reference time related with the period which the compression mechanism (8) needs to carry out the movement at the predefined velocity level (34) to determine the rotation turn velocity (33).

10. A method according to claim 9, wherein the predefined velocity level (34) guarantees that an inertia of the mechanical assembly (12) will be capable to carry out a complete compression cycle.

11. A method according to claim 10, wherein the step (c) is initiated at a moment (35) following completion of a compression cycle.

12. A method according to claim 11, wherein the step (c) is finished at a moment when the at least one compression cycle begins.

13. A method according to claim 9, wherein the step (c) is configured to cause deceleration of the rotation turn velocity (33).

14. A method according to claim 13, wherein the step (c) is configured so that the rotation turn velocity (33) of the compression mechanism (8) has a zero value at a moment when the new compression cycle begins.

15. A method according to claim 9, wherein the step (c) is carried out by applying the braking torque (36) contrary to the rotation turn velocity (33).

16. A method according to claim 9, wherein the step (c) is carried out by applying the braking torque (36) continuously until the mechanical assembly (12) stops.

* * * * *